US007073572B2

(12) United States Patent
Ayub

(10) Patent No.: US 7,073,572 B2
(45) Date of Patent: Jul. 11, 2006

(54) FLOODED EVAPORATOR WITH VARIOUS KINDS OF TUBES

(76) Inventor: Zahid Hussain Ayub, 3305 Thorntree Ct., Arlington, TX (US) 76016

( * ) Notice: Subject to any disclaimer, the term of this patent is extended or adjusted under 35 U.S.C. 154(b) by 252 days.

(21) Appl. No.: 10/463,446

(22) Filed: Jun. 18, 2003

(65) Prior Publication Data

US 2004/0256088 A1 Dec. 23, 2004

(51) Int. Cl.
*F28F 13/14* (2006.01)

(52) U.S. Cl. ..... 165/146; 62/471

(58) Field of Classification Search ..... 165/146
See application file for complete search history.

(56) References Cited

U.S. PATENT DOCUMENTS

| | | | | |
|---|---|---|---|---|
| 2,065,708 | A * | 12/1936 | Keirle | 165/146 |
| 2,147,788 | A | 2/1939 | Gay | |
| 2,312,312 | A | 3/1943 | Beline | |
| 2,535,996 | A | 12/1950 | Worn et al. | |
| 3,267,693 | A | 8/1966 | Richardson et al. | |
| 3,345,829 | A * | 10/1967 | Hall | 165/146 |
| 3,521,708 | A | 7/1970 | Webb | |
| 3,696,861 | A | 10/1972 | Webb | |
| 3,789,617 | A | 2/1974 | Rannow | |
| 3,821,018 | A | 6/1974 | Grant | |
| 4,016,835 | A * | 4/1977 | Yarden et al. | 165/146 |
| 4,018,264 | A | 4/1977 | Albertson | |
| 4,060,125 | A | 11/1977 | Fujie et al. | |
| 4,179,911 | A | 12/1979 | Saier et al. | |
| 4,182,412 | A | 1/1980 | Shum | |
| 4,216,826 | A | 8/1980 | Fujikake | |
| 4,671,082 | A | 6/1987 | Maeda et al. | |
| 5,561,987 | A * | 10/1996 | Hartfield et al. | 62/471 |
| 5,697,430 | A | 12/1997 | Thors et al. | |
| 5,839,294 | A | 11/1998 | Chiang et al. | |
| 5,915,468 | A * | 6/1999 | Inoue et al. | 165/146 |
| 5,933,953 | A | 8/1999 | Spencer et al. | |
| 6,161,613 | A * | 12/2000 | Huenniger | 62/325 |
| 6,189,491 | B1 * | 2/2001 | Wittchow et al. | 165/146 |
| 6,293,112 | B1 * | 9/2001 | Moeykens et al. | 62/84 |
| 6,302,194 | B1 * | 10/2001 | Kastner et al. | 165/133 |
| 6,457,516 | B1 | 10/2002 | Brand et al. | |
| 6,516,627 | B1 | 2/2003 | Ring et al. | |

FOREIGN PATENT DOCUMENTS

| | | | | |
|---|---|---|---|---|
| DE | 3121346 A1 * | 12/1982 | | 165/146 |
| JP | 58052981 A * | 3/1983 | | 165/146 |

OTHER PUBLICATIONS

Isotherm, Inc., Flooded Ammonia Rink Chillers, 2000.

Zahid H. Ayub and Stephen K. Knewitz, Limited Inventory Ammonia Film Spray Evaporator, International Institute of Ammonia Refrigeration, Mar. 1991 Annual Meeting, pp. 61-78.

X. Zeng, M.C. Chyu and Z.H. Ayub, Characteristic Study of Sprayed Fluid Flow in a Tube Bundle, American Society of Heating, Refrigerating and Air-Conditioning Engineers, Inc., 1994, 10 pages.

R.M. Manglik and A.D. Kraus, Process, Enhanced, and Multiphase Heat Transfer, Begell House, Inc., New York, pp. 333-338, date unknown.

* cited by examiner

*Primary Examiner*—Leonard R. Leo
(74) *Attorney, Agent, or Firm*—Geoffrey A. Mantooth

(57) ABSTRACT

An evaporator for a refrigeration system is disclosed which includes a tube bundle with various kinds of tubes. Depending upon the size of a tube bundle, at least two different kinds of tubes are used along the height of the tube bundle. Highly efficient nucleate boiling characteristics tubes are used in the lower section and prime surface or only inside surface enhanced tubes are used in the top section to minimize the adverse effects of vapor blanketing. Tubes in the mid sections could be the same or different than the tubes in the lower and upper sections.

16 Claims, 5 Drawing Sheets

FLOODED EVAPORATOR WITH VARIOUS KINDS OF TUBES

FIELD OF INVENTION

The present invention relates to Shell and Tube Flooded Evaporators for refrigeration applications.

BACKGROUND OF THE INVENTION

Shell and tube flooded evaporator is an integral part of a refrigeration system. In a typical refrigeration system there is an evaporator that cools the process fluid at the expense of boiling the refrigerant that is at a lower saturation temperature and pressure, a compressor that compresses the boiled off refrigerant to an elevated pressure and temperature, a condenser that condenses the high pressure refrigerant to liquid phase at the expense of heating the cooling medium, and an expansion device that drops down the pressure of the condensed refrigerant back to the low side which then enters the evaporator to repeat the above cycle again. This cycle is called the reverse Rankine cycle.

Enhanced surface tubes such as shown in U.S. Pat. Nos. 3,521,708, 3,696,861, 3,821,018, 4,018,264, 4,060,125, 4,179,911, 4,182,412, 4,216,826, 5,697,430, 5,933,953 and 6,457,516 are being used on a regular basis in flooded refrigerant evaporators to reduce the overall size and/or refrigerant charge. In a large capacity unit these high efficiency tubes could create so much vapor that sometimes it may cause negative effects in the upper sections of the evaporator tube bundle. Hence, resulting in no benefit at a higher cost. Therefore, it is desirable to design and fabricate a tube bundle with various kinds of tubes along the height of the bundle that would result in a most optimized and economical evaporator.

SUMMARY OF THE INVENTION

It is an object of the present invention to provide a tube bundle configuration that would utilize various kinds of tubes. These tubes are selected on its individual merits within different sections of the tube bundle of an evaporator.

It is another object of the present invention to provide a bundle layout for a flooded shell and tube evaporator that would result in an economical and optimized unit.

A flooded evaporator consists of a shell, tube sheets, baffles or tube supports, tie-rods and tubes. The tubes are in a horizontal position and held together at certain distance to each other by the baffles or tube supports, tie-rods and the tube sheets at each end. This section of the evaporator is also called a tube bundle. The tube bundle is enclosed within a shell by weldment at the location where the shell meets the tube sheets. To create an optimized and economical bundle various kinds of tubes are used in different sections of the bundle. Tubes with high nucleate boiling characteristics are used in the lower section with progressively different types of tubes along the height of the bundle according to the upward moving two phase flow of the refrigerant on the shell side. The top section where the vapor concentration is the highest can utilize prime (plain) surface tubes.

DESCRIPTION OF THE PREFERRED EMBODIMENT

Figure 1:
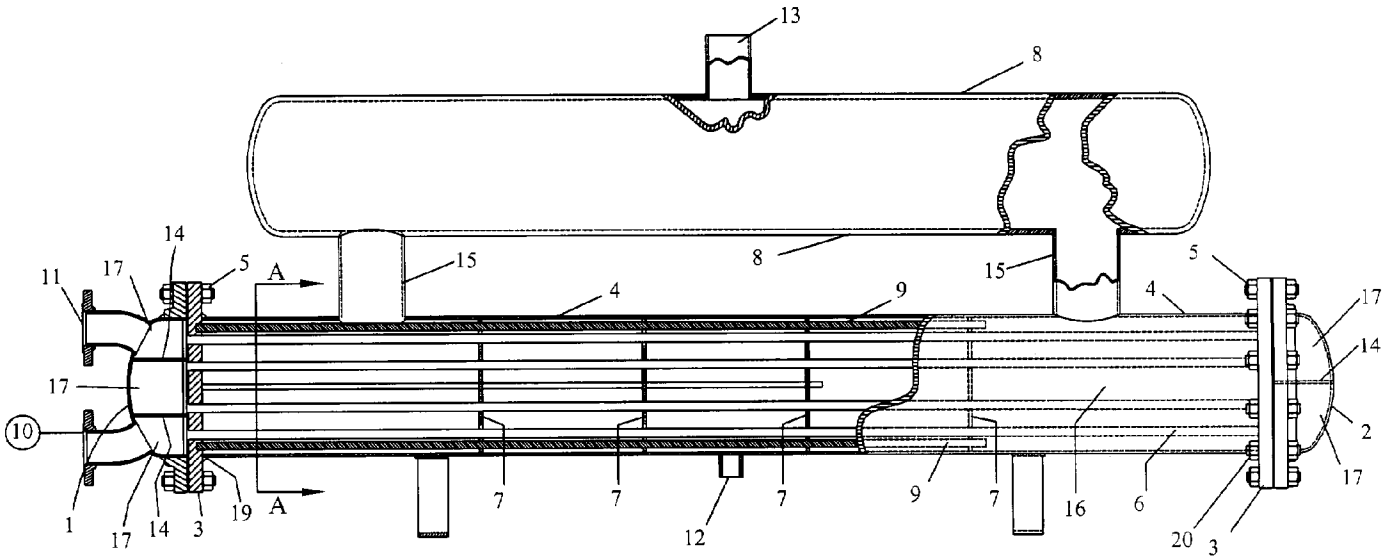
FIG. 1 is a frontal view of an even-pass (four pass) flooded shell and tube evaporator.
Figure 2:
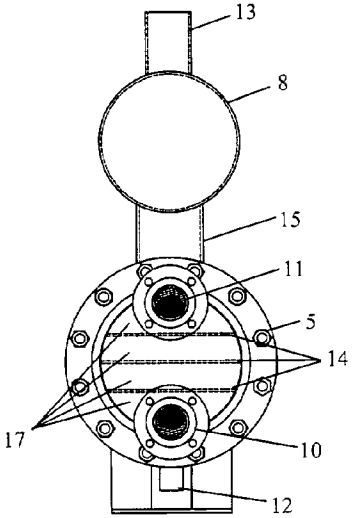
FIG. 2 is a side view of FIG. 1 flooded shell and tube evaporator.
Figure 5:
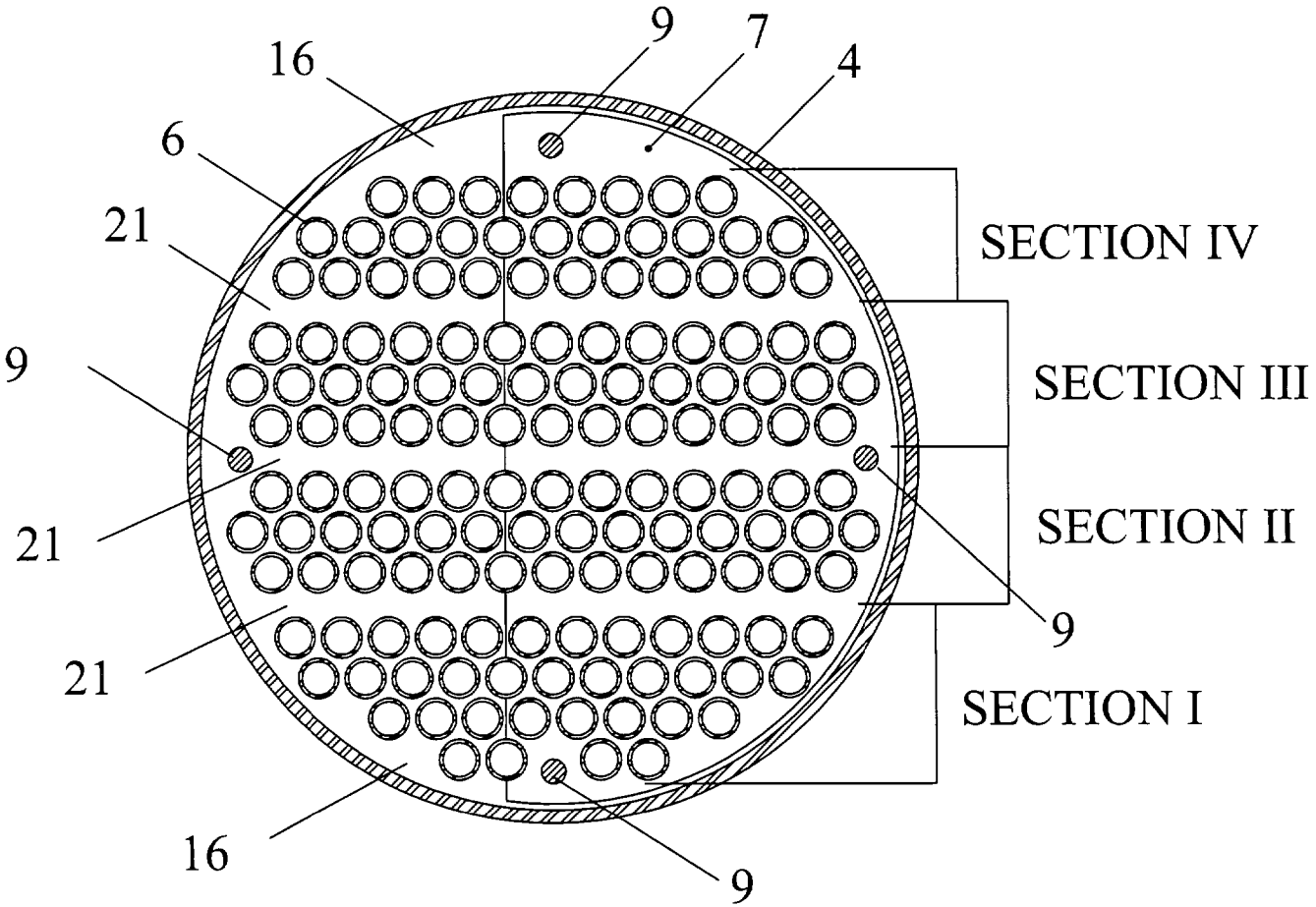
FIG. 5 is a cross sectional view of a tube bundle of FIG. 1 at Section A—A, showing four different kinds of tubes in Sections I, II, III, and IV along the bundle height, respectively.

In FIGS. 1 and 2 a shell and tube evaporator is shown with plurality of parallel tubes in horizontal orientation. The tubes 6 are received at each end by two end plates 3 (round or rectangular in shape) called tube sheets, which has, plurality of parallel holes that are machined at specific distance to each other according to industry standards, viz., Tubular Exchanger Manufacturers Association, TEMA. The tubes are further supported by baffles or tube supports 7 within the span between the tube sheets 3. The distance between the adjacent baffles or tube supports 7 is determined according to industry standards, e.g., Tubular Exchanger Manufacturers Association, TEMA. The baffles or tube supports 7 have hole pattern identical to the tube sheets 3 as shown in FIG. 5 (larger scale). The combination of tube sheets 3, the tubes 6, the baffles or tube supports 7 and the tie-rods 9 also known as tube bundle is welded to the shell 4 at each ends, 19 and 20, hence isolating the shell side 16 from the tube side 17. The tubes 6 are individually joined to the tubesheets 3 at the corresponding holes in the tubesheets 3 via mechanical means or welding.

Figure 4:
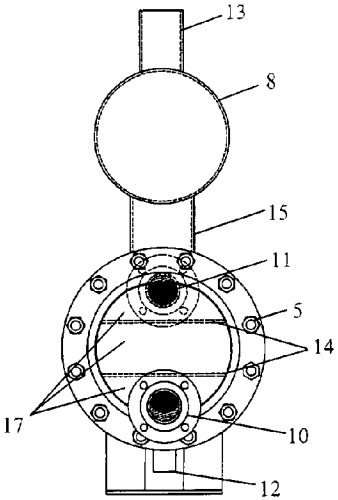
FIG. 4 is a side view of FIG. 3 flooded shell and tube evaporator.
Figure 3:
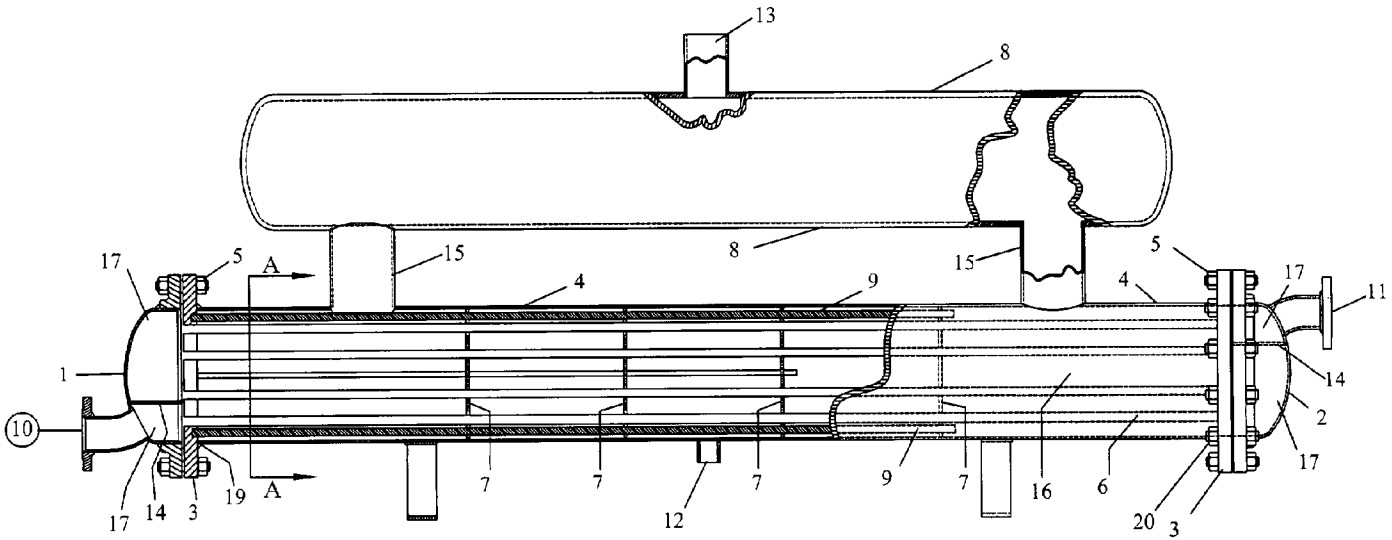
FIG. 3 is a frontal view of an odd-pass (three pass) flooded shell and tube evaporator.

The process fluid such as water or brine or any other fluid to be cooled enters the tube side 17 at the front head 1 (attached to the tubesheets 3 through bolting 5 or welding) via inlet port 10. Depending upon the nature of application, the heads 1 and 2 could be arranged for multiple pass or single pass configuration. In the case of multiple pass the front head 1 and the rear head 2 carry pass partition plates 14 at the corresponding lane 21 on the tube sheets 3 that directs the process fluid in the tubes 6 back and front through respective quantity of tubes in each pass until the fluid exits at head 1 via port 11 for even-pass configuration as shown in FIG. 1 and FIG. 2 or at head 2 for odd-pass configuration as shown in FIG. 3 and FIG. 4 via exit port 11.

Low temperature and low pressure liquid or liquid-gas mixture of refrigerant enters the shell side 16 via port 12. As the refrigerant travels upwards it extracts heat from the hot fluid in the tubes 6 and progressively evaporates. The vapor/liquid ratio increases along the height of the tube bundle. The wet vapor exits the shell side 16 via risers 15 and enters the separator 8 and leaves the separator 8 as liquid-free vapor via port 13.

Figure 6:
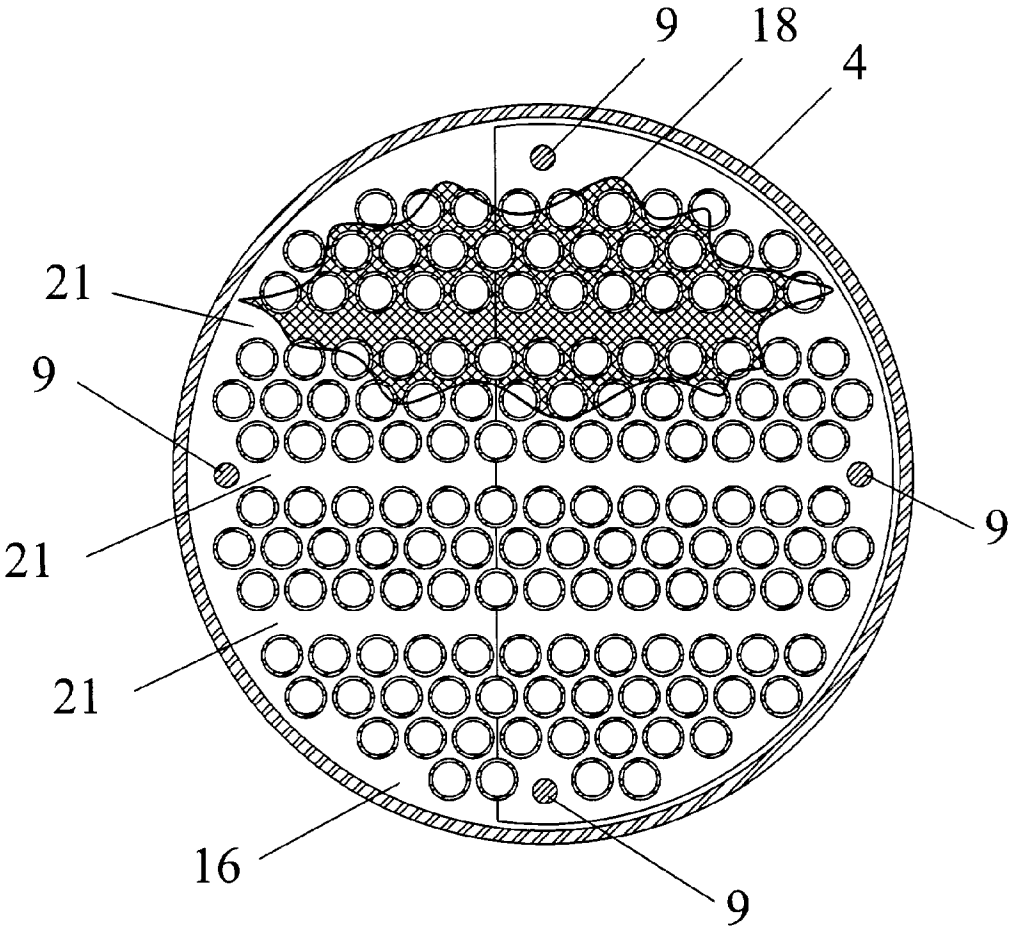
FIG. 6 shows a cross sectional view of the tube bundle showing vapor rich zone.

Recently the use of high efficiency tubes in flooded evaporators has become a common feature in many commercial and industrial refrigeration applications. These tubes have the quality to boil off refrigerant at lower temperature differentials and also develop high-density bubble sites per unit tube length. This results in higher cooling capacity compared to conventional prime (plain) surface tubes. Because of this feature the vapor generation becomes so intense that it causes high vapor-rich zone 18 in the upper section of a tube bundle as shown in FIG. 6. High vapor content is not desirable since it starves the tubes of liquid refrigerant. Saturated vapor phase has lower heat transfer capability versus saturated liquid refrigerant. Hence, the overall efficiency of the evaporator drops.

In view of this behavior this invention proposes utilization of various kinds of tubes appropriately selected along the height of the tube bundle, with high efficiency tubes having strong nucleate boiling characteristics in the lower section, say, Section I as shown in FIG. 5, followed by tubes with moderate nucleate boiling characteristics in Section II (FIG. 5), still another suitable kind of tubes in Section III (FIG. 5) and prime surface (plain) tubes in Section IV as shown in FIG. 6. Depending on the size of the tube bundle these different kinds of tubes are then selected accordingly. This invention results in a lower cost by replacing the otherwise enhanced tubes in the top section with less expensive prime surface (plain) tubes and also results in highly optimized evaporator with no parasitic losses. In yet another embodiment the selection of the top section tubes would depend on the type of process fluid being cooled in the tubes 6. If the process fluid has high viscosity, then tubes with prime (plain) surface on the outside and enhancement on the inside could be used.

Figure 7:
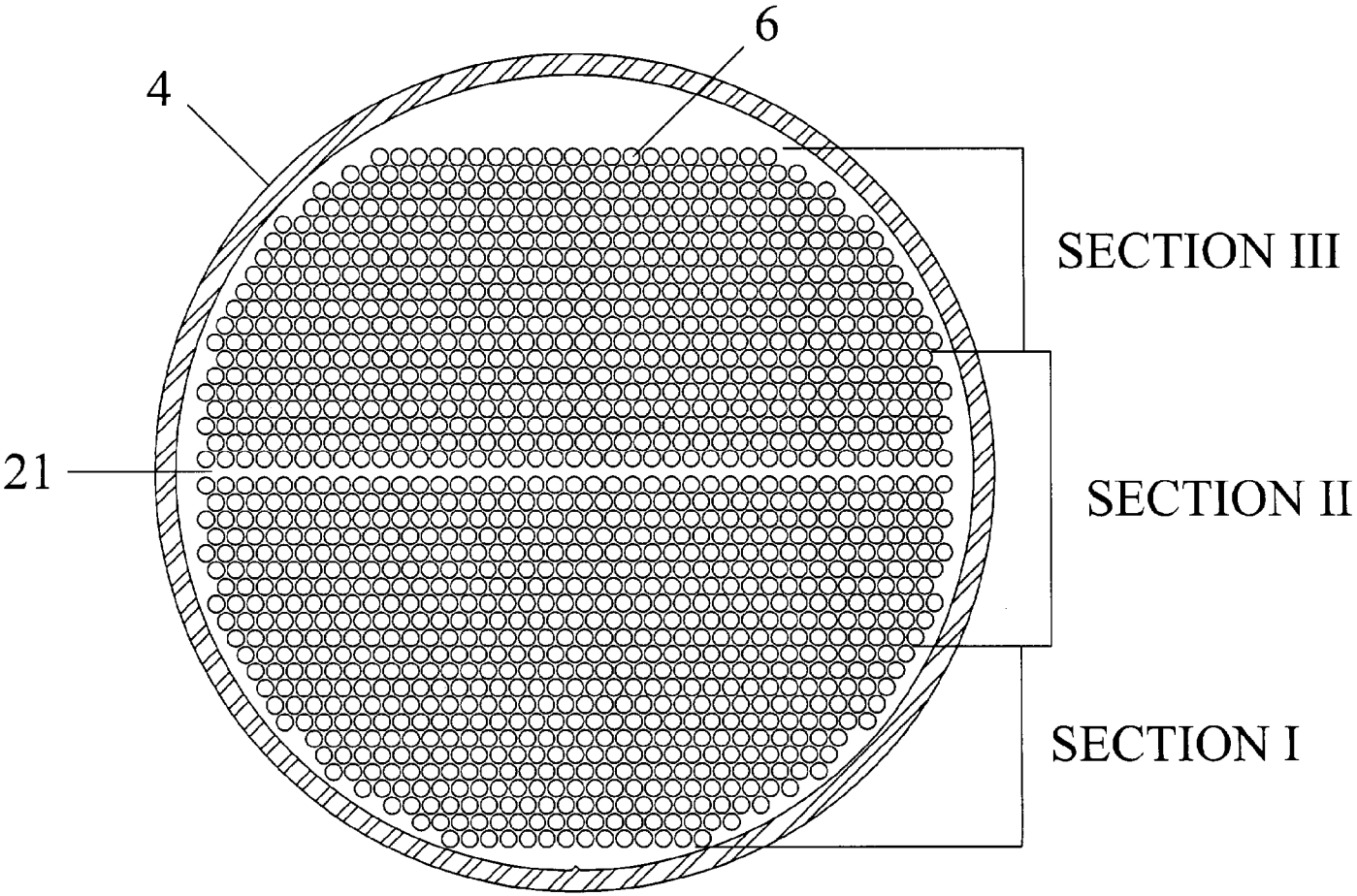
FIG. 7 shows a large two pass tube bundle with three kinds of tubes in corresponding three sections (I, II, and III) along the bundle height.

The tube distribution along the height of the bundle is dictated by the bundle depth, temperature differential between inlet port 10 and outlet port 11, the temperature difference between the tube side 17 and the shell side 16, the type of pass arrangement on the tube side 17 and the transport properties of the process fluid being cooled. One arrangement could be to match the number of tube kinds with the number of passes on the tube side 17, e.g., for two pass arrangement two different kinds of tubes could be used. If the bundle height is large and has two or less passes on the tube side 17, it can have more than two kinds of tubes depending upon the design parameters, e.g., in FIG. 7 a large tube bundle with two pass arrangement could have three different kinds of tubes in Section I, II, and III, respectively. The foregoing disclosure and the showings made in the drawings are merely illustrative of the principles of this invention and are not to be interpreted in a limiting sense.

What is claimed is:

1. A flooded shell and tube evaporator, comprising:

a) a shell having an inlet and an outlet and having a first end and a second end;

b) a plurality of tubes located in the shell and extending between the first and second ends, the tubes forming a path through the shell, the path comprising at least one pass through the shell;

c) supports that position the tubes within the shell, the shell having a first portion and a second portion, the second portion located above the first portion, the first and second portions being flooded with refrigerant;

d) the plurality of tubes comprising at least two types, with a first type of tube being located in the first portion and a second type of tube being located in the second portion;

e) the first portion having a mode of heat transfer that is different from the mode of heat transfer in the second portion, the first and second type of tubes having heat transfer characteristics suitable for the heat transfer of the respective first and second portions, wherein the heat transfer characteristics of the first type of tube is different than the heat transfer characteristics of the second type of tube; f) the plurality of tubes further comprising a third type of tube having a third heat exchange efficiency that is less than the first heat exchange efficiency and greater than the second heat exchange efficiency, the third type of tubes located between the first and second type of tubes.

2. The evaporator of claim 1 wherein the second type of tubes are positioned between the first type of tubes and the shell outlet.

3. The evaporator of claim 2 wherein the shell outlet is located above the shell inlet and the second type of tubes are located above the first type of tubes.

4. The evaporator of claim 1 wherein the tubes form plural passes through the shell, with the number of tube types being the same as the number of passes, with each type of tube having a heat exchange efficiency that is different from the other types of tubes.

5. The evaporator of claim 1 wherein the tubes form plural passes through the shell, with the number of tube types being unequal to the number of passes, with each type of tube having a heat exchange efficiency that is different from the other types of tubes.

6. The evaporator of claim 1 wherein the first tube types comprise tubes with highly nucleate boiling characteristics.

7. The evaporator of claim 1 wherein the second tube type comprises tubes with prime surfaces.

8. The evaporator of claim 1 wherein the second type of tubes comprises tubes with a prime surface on the outside of each tube and an inside surface of each tube that has a higher heat exchange efficiency than does the outside surface.

9. A flooded shell and tube evaporator, comprising:

a) a shell having an inlet and an outlet and having a first end and a second end;

b) a plurality of tubes located in the shell and extending between the first and second ends, the tubes forming a path through the shell, the path comprising at least one pass through the shell;

c) supports that position the tubes within the shell;

d) the plurality of tubes comprising at least two types, with a first type of tube having a first heat exchange efficiency and a second type of tube having a second heat exchange efficiency, with the first heat exchange efficiency being greater than the second heat exchange efficiency;

e) the plurality of tubes further comprising a third type of tube having a third heat exchange efficiency that is less than the first heat exchange efficiency and greater than the second heat exchange efficiency, the third type of tubes located between the first and second type of tubes.

10. The evaporator of claim 9 wherein the plurality of tubes further comprises a fourth type of tube having a fourth heat exchange efficiency that is less than the third heat exchange efficiency and greater than the second heat exchange efficiency, the fourth type of tubes being located between the third and second type of tubes.

11. A flooded shell and tube evaporator, comprising:

a) a shell having a refrigerant inlet and a refrigerant outlet, the shell having first and second ends, the shell having an upper portion and a lower portion, the shell being flooded with refrigerant;

b) a plurality of tubes extending through the shell between the first and second ends, the tubes forming a path for a process fluid from a process fluid inlet through the shell to a process fluid outlet, the path comprising at least two passes through the shell, with the vapor-to-liquid ratio being higher in the upper portion than in the lower portion;

c) supports that position the tubes within the shell;

d) the plurality of tubes comprising at least two types, with the first type forming the path by the process fluid inlet and having heat transfer characteristics suitable for the lower vapor-to-liquid ratio of the lower section and the second type forming a path by the process fluid outlet and having heat transfer characteristics suitable for the higher vapor-to-liquid ratio and that minimizes a vapor rich zone in the shell around the pass of tubes at the end of the process fluid path;

e) the plurality of tubes further comprising a third type of tube having a third heat exchange efficiency that is less than the first heat exchange efficiency and greater than the second heat exchange efficiency, the third type of tubes located between the first and second type of tubes.

12. The evaporator of claim 11 wherein the first type of tubes comprise tubes with highly nucleate boiling characteristics.

13. The evaporator of claim 11 wherein the second type of tubes comprise tubes with prime surfaces.

14. The evaporator of claim 11 wherein the second type of tubes comprise tubes with a prime surface on the outside of each tube and an inside of each tube that has a higher heat exchange efficiency than does the outside surface.

15. A flooded shell and tube evaporator, comprising:

a) a shell having a refrigerant inlet and a refrigerant outlet, the shell having first and second ends;

b) a plurality of tubes extending through the shell between the first and second ends, the tubes forming a path for a process fluid from a process fluid inlet through the shell to a process fluid outlet, the path comprising at least two passes through the shell;

c) supports that position the tubes within the shell;

d) the plurality of tubes comprising at least two types, with the first type forming the path by the process fluid inlet and being of a first heat exchange efficiency and the second type forming a path by the process fluid outlet and being of a second heat exchange efficiency that is less than the first heat exchange efficiency and that minimizes a vapor rich zone in the shell around the pass of tubes at the end of the process fluid path;

e) the plurality of tubes further comprising a third type of tube having a third heat exchange efficiency that is less than the first heat exchange efficiency and greater than the second heat exchange efficiency, the third type of tubes located between the first and second type of tubes.

16. The evaporator of claim 15 wherein the plurality of tubes further comprises a fourth type of tube having a fourth heat exchange efficiency that is less than the third heat exchange efficiency and greater than the second heat exchange efficiency, the fourth type of tubes being located between the third and second type of tubes.

* * * * *